US005672238A

United States Patent [19]

Samuelson

[11] Patent Number: 5,672,238

[45] Date of Patent: Sep. 30, 1997

[54] HANGER SHEET AND TAPE DISPENSER COMBINATION

[75] Inventor: Bruce E. Samuelson, Stillwater, Minn.

[73] Assignee: Minnesota Mining and Manufacturing Company, St. Paul, Minn.

[21] Appl. No.: 501,300

[22] Filed: Jul. 12, 1995

[51] Int. Cl.[6] ..... B32B 31/00

[52] U.S. Cl. ..... 156/579; 206/349; 206/806

[58] Field of Search ..... 206/349, 806; 156/523, 527, 574, 577, 579

[56] References Cited

U.S. PATENT DOCUMENTS

| | | | |
|---|---|---|---|
| D. 362,684 | 9/1995 | Samuelson et al. | D19/69 |
| 4,358,328 | 11/1982 | Pearson | 156/73.1 |
| 4,650,074 | 3/1987 | Vosbikian | 206/477 |
| 4,968,540 | 11/1990 | Linsenbigler | 206/806 X |
| 5,141,104 | 8/1992 | Morrow et al. | 206/806 X |
| 5,468,332 | 11/1995 | Dretzka et al. | 156/527 |

FOREIGN PATENT DOCUMENTS

| | | | |
|---|---|---|---|
| 2226010 | 6/1990 | United Kingdom | 206/806 |

OTHER PUBLICATIONS

International Search Report for PCT/US96/0888.

*Primary Examiner*—James Engel

*Attorney, Agent, or Firm*—Gary L. Griswold; Walter N. Kirn; William L. Huebsch

[57] ABSTRACT

A combination of a tape dispenser including a molded polymeric frame and a cutting blade on a blade support portion of the frame, and a hanger sheet (e.g., of card stock and printed with trademark and use information) having a first end portion engaged with the frame of the dispenser, and a second portion projecting from the dispenser and having an opening adapted to receive a peg in a sales display area so that the tape dispenser can be hung from the peg by the hanger sheet. The blade support portion of the dispenser comprises a plurality of spaced projections from an inner surface of a dispenser wall that have generally coplanar distal end surfaces on which the blade is mounted. The first end portion of the hanger sheet has openings receiving the projections with the first end portion of the sheet around the projections, between the cutting blade and the inner surface of the wall supporting the projections. The hanger sheet can be separated from the dispenser by tearing it along lines of weakness intersecting those openings.

8 Claims, 3 Drawing Sheets

HANGER SHEET AND TAPE DISPENSER COMBINATION

TECHNICAL FIELD

The present invention relates to hanger sheets, typically of card stock and printed with trademark and product information, that are engaged with manually operated tape dispenser and tape roll assemblies and are adapted to be hung from pegs in a sales display area. Such a hanger sheet typically is removed from the tape dispenser and tape roll assembly before it is used to dispense tape.

BACKGROUND ART

For many years Minnesota Mining and Manufacturing Company (3M), St. Paul, Minn., has sold a light duty or disposable prior art tape dispenser under the trade designation "Scotch(TM) Brand C-147 dispenser which is similar to the tape dispenser described in U.S. Pat. No. 4,358,328. That tape dispenser supports a roll of tape from which lengths of the tape may be manually withdrawn, and includes a cutting blade on a blade support portion that can transversely cut a dispensed length of tape. A card stock hanger sheet printed with trademark and product information is attached to the tape dispenser as it is sold. That hanger sheet has a first end portion attached to the frame of the dispenser by sonic welding, and a second end portion projecting from the blade support portion of the dispenser that has an opening adapted to receive a peg in a sales display area to hang the tape dispenser from the peg. That hanger sheet is perforated between the portions, and its second end portion is typically removed along the line of perforations and discarded by a purchaser prior to dispensing tape from the dispenser.

U.S. Pat. No. 5,468,332 issued Nov. 21, 1995, describes an improved tape dispenser generally of the type described above and also describes a novel means by which a card stock card or hanger sheet of the type described above could be attached to it. That hanger sheet attachment means includes engagement of portions of the card under an opposed pair of spaced and aligned plate-like attachment portions formed on the frame of the dispenser.

DISCLOSURE OF THE INVENTION

The present invention provides an improved means for attaching a card or hanger sheet to a dispenser such as (but not limited to) the dispenser described in U.S. Pat. No. 5,468,332 issued Nov. 21, 1995, and illustrated in Design U.S. Pat. No. D362,684 issued Sept. 26, 1995 , the contents whereof are hereby incorporated herein by reference.

According to the present invention there is provided the combination of a tape dispenser including a molded polymeric frame with a blade support portion on which is mounted a cutting blade, and a hanger sheet (e.g., of card stock and printed with trademark and use information) having a first end portion engaged with the frame of the dispenser, and a second portion projecting from the dispenser and having an opening adapted to receive a peg in a sales display area so that the tape dispenser can be hung from the peg by the hanger sheet. The blade support portion of the dispenser comprises a plurality of spaced projections from an inner surface of a dispenser wall, which projections have generally coplanar distal end surfaces. The first end portion of the hanger sheet has openings receiving the projections with the first end portion of the sheet around the projections, and the blade is mounted along the distal end surfaces of the projections with the first end portion of the hanger sheet between the cutting blade and the inner surface of the wall supporting the projections.

Preferably, the projections of the cutter support portion are elongate and are spaced along an end of the frame with the lengths of the projections at a right angle to that end, the cutting edge on the blade is parallel with and disposed at that end, and the second end portion of the hanger sheet projects past the cutting edge and that end of the frame.

The first end portion of the hanger sheet can have one or more paths of weakness (e.g., lines of perforations or thinned portions of the hanger sheet) along which parts of the hanger sheet may be separated or torn to facilitate removing the hanger sheet from the frame. For example, such a path of weakness can extend transverse of the hanger sheet through the openings in the first portion of the hanger sheet so that the hanger sheet can easily be torn into two parts and those parts can be removed from the dispenser; or the first end portion of the hanger sheet can have generally parallel paths of weakness from its projection receiving openings to an adjacent edge of the hanger sheet along which parallel paths of weakness the hanger sheet may be torn so that the first portion of the hanger sheet can be pulled from around the projections and the entire hanger sheet can be separated from the tape dispenser.

BRIEF DESCRIPTION OF DRAWING

The present invention will be further described with reference to the accompanying drawing wherein like reference numerals refer to like parts in the several views, and wherein.

DESCRIPTION OF THE PREFERRED EMBODIMENT

Figure 1:
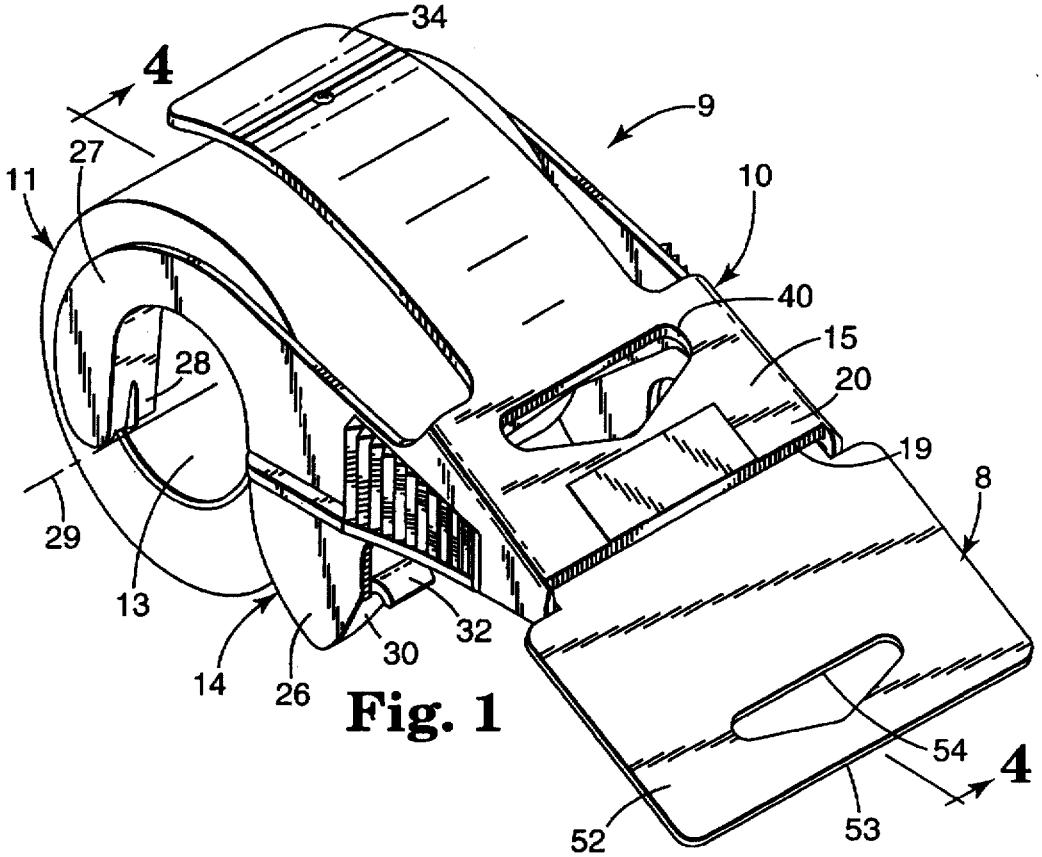
FIG. 1 is a perspective view of a combination of a tape dispenser, a roll of tape, and a hanger sheet according to the present invention.
Figure 2:
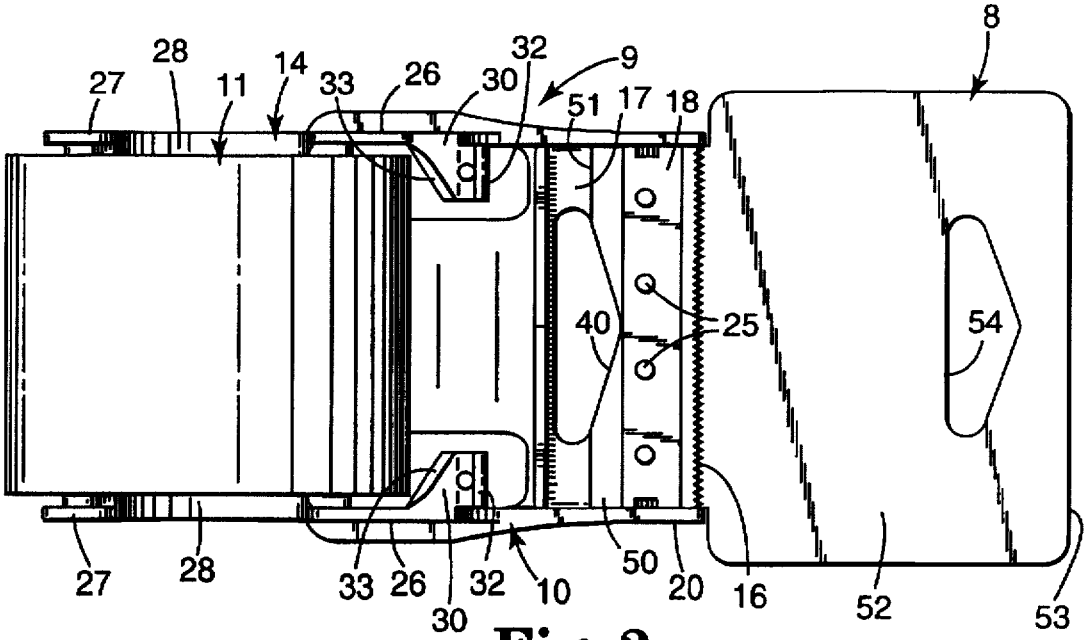
FIG. 2 is a bottom view of the combination shown in FIG. 1.
Figure 3:
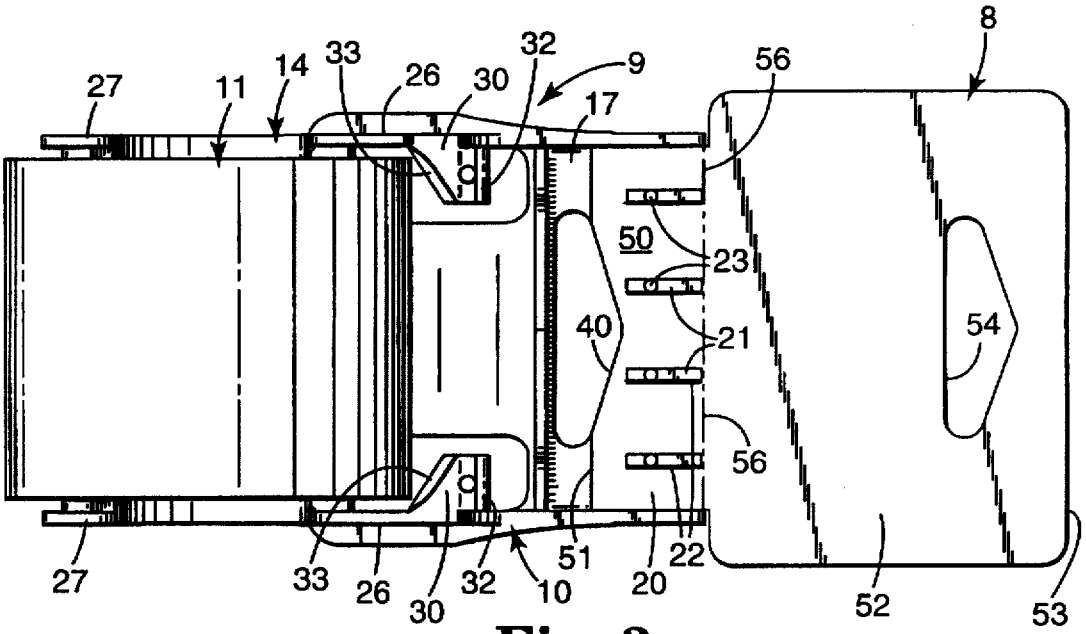
FIG. 3 is a bottom view of the combination shown in FIG. 1 with a cutting blade of the tape dispenser removed to show detail of the hanger sheet.
Figure 4:
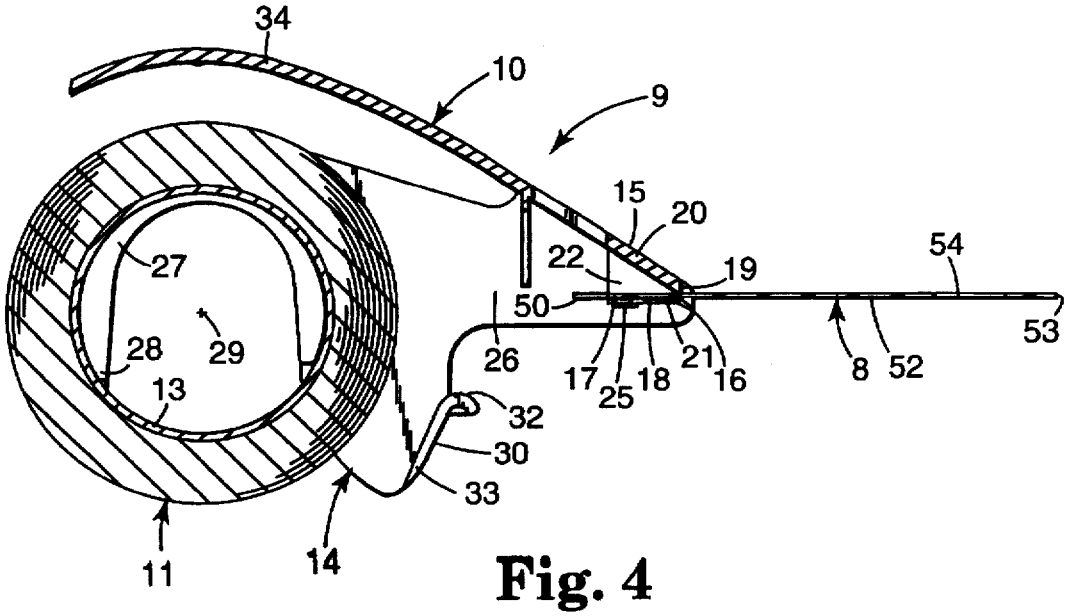
FIG. 4 is a cross sectional view of the combination of FIG. 1 taken approximately along line 4—4 of FIG. 1.

Referring now to FIGS. 1 through 4 of the drawing, there is shown a combination 9 according to the present invention of a tape dispenser 10 for a roll 11 of tape including a supply length of the tape wound on a core 13; and a hanger sheet 8 for the dispenser 10.

The tape on the roll 11 can, for example, be one of the 2 inch wide tapes including a coating of aggressive pressure sensitive adhesive on a clear or tan colored polypropylene backing or on a polymeric backing that includes longitudinally extending fiberglass filaments that are sold as packaging or mailing tape by Minnesota Mining and Manufacturing Company, St. Paul, Minn.

The dispenser 10 comprises a frame 14 integrally molded of a polymeric material (e.g., polystyrene), and a thin metal plate or blade 18 attached to the frame 14. The metal plate or blade 18 provides means for defining a generally straight tape cutting edge 16 comprising a row of generally triangular teeth that are adapted to transversely cut the tape without being excessively sharp so that they do not cause an undue risk of cutting a person using the dispenser 10.

The frame 14 of the dispenser 10 comprises a projecting cutter support portion 20. The cutter support portion 20 includes a wall having slightly curved but generally planar parallel outer and inner surfaces 15 and 17, and a plurality of spaced elongate ribs or projections 22 projecting from the inner surface 17 of the wall and disposed at right angles to an end 19 of the frame 14. The projections 22 have generally coplanar distal end surfaces 21 on which the blade 18 is mounted by blade attachment means with its cutting edge 16 at the end 19 of the frame 14. That blade attachment means is provided by posts 23 projecting from the distal end surfaces 21 and extending though close fitting openings in the blade 18, which posts 23 have cold formed heads 25 engaging the surface of the blade 18 opposite the projections 22.

The hanger sheet 8 includes a first end portion 50 adjacent a first end 51 of the hanger sheet 8 that has openings receiving the projections 22 with the first end portion 50 of the sheet 8 around the projections 22. The hanger sheet 8 also includes a second portion 52 adjacent a second end 53 of the sheet 8 that has a generally triangular opening 54 adapted to receive a peg in a sales display area to hang the hanger sheet 8 and tape dispenser 10 combination from that peg, The blade attachment means mounts the blade 18 along the distal end surfaces 21 of the projections 22 with the first end portion 50 of the hanger sheet 8 between the cutting blade 18 and the inner surface 17, and with the second end portion 52 of the hanger sheet 8 projecting past the cutting edge 16 of the blade 18 and the end 19 of the frame 14. The projections 22 are sized to space the blade 18 from the inner surface 17 at the end 19 of the frame 14 by a larger distance (e.g., 0.020 inch) than the thickness of the hanger sheet 8 (e.g., 0.015 inch) so that the hanger sheet 8 is not clamped in that space.

The first end portion 50 of the hanger sheet 8 has a path of weakness or line of perforations 56 defining parts of the hanger sheet 8 that may be separated or torn to facilitate removing the hanger sheet 8 from the frame 14. As illustrated (see FIG. 3), that line of perforations 56 extends transverse of the hanger sheet 8 through the openings in the first end portion 50 of the hanger sheet 8 through which the projections 22 project. To remove the hanger sheet 8 from the tape dispenser 10, a user simply pulls on its second end portion 52 until it separates or tears into two parts along the line of perforations 56, after which those parts into which the hanger sheet 8 has been separated will be unattached to the dispenser and can be disposed of.

Figure 5:
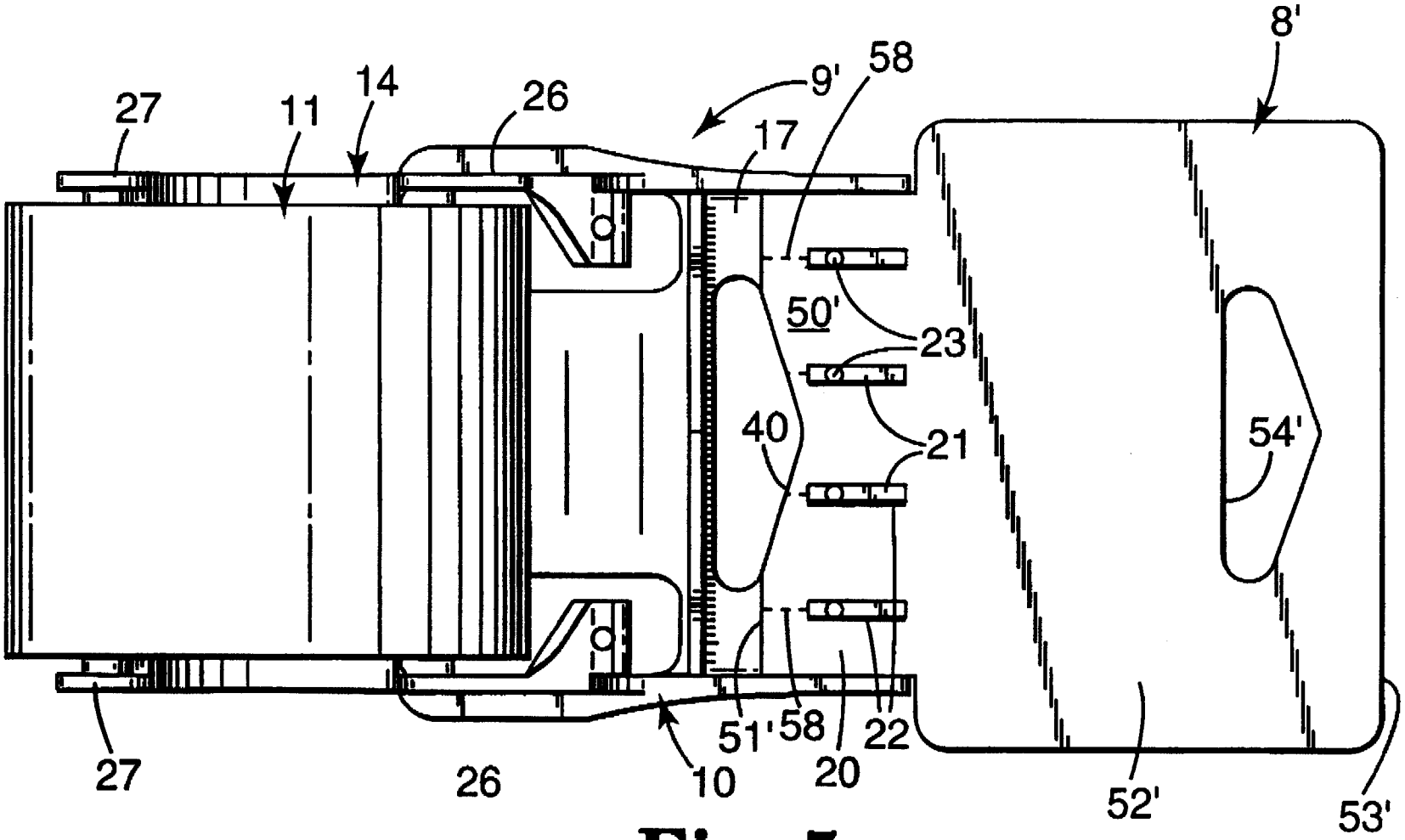
FIG. 5 is a bottom view similar to FIG. 3 which illustrates a modification in the hanger sheet of the combination.

An alternative to the line of perforations 56 illustrated in FIGS. 1–4 is shown in FIG. 5. As shown in FIG. 5, the first end portion 50' of the hanger sheet 8' can have generally parallel paths of weakness or lines of perforations 58 from the openings in the first end portion 50' of the hanger sheet 8' through which the projections 22 project to the adjacent first end 51' of the hanger sheet 8'. Such lines of perforations 58 define parts of the hanger sheet 8' that may be separated by tearing the hanger sheet 8' along the perforations 58 to facilitate separation of the hanger sheet 8' from the frame 14 of the dispenser 10. When the second end portion 52' of the hanger sheet 8' is pulled on to separate it from the dispenser 10, the hanger sheet 8' will tear or separate along the lines of perforations 58 and can be pulled from the dispenser 10. The use of such lines of perforations 58 provides the advantage that the hanger sheet 8' will remain in one piece after it is separated from the dispenser 10, thereby facilitating its disposal.

The hanger sheet can also be made without any perforations, and will typically tear apart between the openings receiving the projections 22 when the second end portion of the hanger sheet is pulled on to separate it from the dispenser 10.

Typically, the hanger sheet 8 is of made of card stock (e.g., 0.014 inch thick solid bleached sulfate) and bears printed indicia on both sides providing trademark and use information.

The frame 14 of the dispenser 10 also includes opposite, generally parallel side wall portions 26 that are attached along opposite edges of the cutter support portion 20 and are disposed at about right angles with respect to the cutting edge 16 and with respect to the support portion 20. Generally C-shaped parts 27 of the side wall portions 26 of the frame support opposed generally C-shaped hub portions 28 of the frame 14 that project toward each other from the inner surfaces of the side wall portions 26 around parts of the peripheries of openings through the side wall portions 26. The hub portions 28 are arcuate about an axis 29 parallel to the tape cutting edge 16, provide peripheral surfaces adapted to rotatably support the cylindrical inner surface of the core 13 for rotation about the axis 29, and are adapted to project into the opposite ends of an opening in the core 13 on the side of the core 13 opposite the blade 18 to rotatably support the roll of tape 11. The side wall portions 26 are resiliently flexible between the hub portions 28 and the cutter support portion 20 so that they can be resiliently bent apart to afford positioning the roll 11 of tape between the hub portions 28 and removing the empty core 13 from therebetween.

The frame 14 also includes opposed locating tab portions 30 projecting toward each other from the adjacent surfaces of the side wall portions 26 at a distance from the axis 29 of the hub portions 28 (e.g., 1.38 inches) that is significantly less than or about half plus or minus 10 percent the distance between the cutting edge 16 and the axis 29 of the hub portions 28 (e.g., 2.76 inches). The locating tab portions 30 have retaining surfaces 32 adjacent the cutter support portion 20 that are arcuate or cylindrically convex about an axis parallel to the axis 29 of the hub portions 28, and are spaced from the cutter support portion 20 so that a first imaginary plane through the axis 29 of the hub portions 28 and the cutting edge 16 is disposed at an angle of at least 12 degrees and preferably in the range of 20 to 70 degrees (e.g., about 20 degrees as illustrated) from a second imaginary plane through the axis 29 of the hub portions 28 that is tangent to the retaining surfaces 32 of the locating tab portions 30. The space between those first and second imaginary planes is unobstructed by any portion of the dispenser 10.

The locating tab portions 30 also have cam surfaces 33 extending from adjacent the side wall portions 26 to the adjacent or inner ends of the locating tab portions 30 on the sides of the locating tab portions 30 opposite the retaining surfaces 32. The cam surfaces 33 cause tape being pulled from the roll 11 of tape on the side of the tab portions 30 opposite the retaining surfaces 32 to be guided between and around the locating tab portions 30 when relative movement is caused between the dispenser 10 and the tape being withdrawn to transversely cut the tape with the cutting edge 16 of the blade 18. The parts of the cam surfaces 33 along the lengths of the cam surfaces 33 are disposed at angles of greater than about 45 degrees, and preferably greater than about 50 degrees, with respect to the surfaces adjacent the cutter support portion 20 of imaginary planes passing through the axis 29 of the hub portions 28 and those parts; the measurements of those angles being taken in planes normal to the surfaces of the imaginary planes. The cam surfaces 33 can be straight or arcuate, include straight and arcuate parts, or include different parts that are arcuate about different axes or are straight and disposed at different angles with respect to the imaginary planes. Also, the opposite ends of the cam surfaces 33 can be disposed at the same or different distances from the axis 29 of the hub portions 28.

The locating tab portions 30 project a small distance into the path of the tape (e.g., 0.33 inch into the path on each side of the path for 2 inch wide tape that the dispenser 10 is adapted to dispense) thereby requiring only a small percentage of the width of the tape (e.g., about 27 percent) to be moved around the locating tab portions 30 by the cam surfaces 33. Thus the space between the adjacent spaced ends of the locating tab portions 30 is at least 60 percent (e.g., 73 percent) of the width of the 2 inch tape the dispenser is intended to dispense.

An arched portion 34 of the frame 14 is joined to and projects from the edge of the cutter support portion 20 opposite the cutting edge 16, and extends partially around the roll of tape 11. The arched portion 34 is resiliently flexible and has a generally cylindrically concave surface adjacent the periphery of the roll 11 of tape in the dispenser 10. The arched portion 34 is adapted to be received in the palm of a user's hand to normally space the user's hand from the rotating roll 11 of tape as tape is being dispensed from the tape dispenser 10, and can be pressed into engagement with the periphery of the roll 11 of tape to stop tape from being withdrawn from the dispenser when the user wishes to sever the tape with the cutting edge 16. The arched portion 34 also discourages a user of the tape dispenser from trying to cut the tape using the wrong side of the tape cutting edge 16.

The frame 14 of the dispenser 10 adjacent the cutter support portion 20 has a generally triangular opening 40 similar in shape and orientation to the opening 54 in the hanger sheet 8. The opening 40 allows the dispenser 10 to be hung from a peg either before or after the hanger sheet 8 is removed, as may be desirable for storage of the dispenser 10 after the hanger sheet 8 is removed, or to stagger the vertical locations of dispensers on a peg by alternately hanging them from the opening 54 in the hanger sheet and the opening 40 to thereby place a larger number of dispensers 10 on that peg than if they were all hung using the hanger sheet 8.

After removing the hanger sheet 8 from the dispenser 10 by tearing it long the line of perforations 56 as described above, a user can use the dispenser 10 by pulling an end of the length of tape away from the tape on the roll 11, applying the end of the tape to the item to be taped, and pulling the dispenser 10 away from the item to dispense the desired length of tape. If the end of the length of tape is initially adhered to the retaining surfaces 32, the tape will be pealed away from those retaining surfaces 32 and will be pulled from the roll 11 in the space between the retaining surfaces 32 and the cutting edge 16 of the blade 18. If the end of the length of tape is initially adhered to the roll 11 (as will be the case when the roll 11 of tape is new), the user pulls that end from the surface of the roll 11 which may most easily be done between the side wall portions 26 on the side of the locating tab portions 30 opposite the cutting edge 16 and the distal end of the arcuate portion 24. The user may continue to pull tape from the roll 11 in that area, however, when a sufficient length of the tape has been withdrawn, the user will orient the dispenser 10 to press the cutting edge 16 of the blade 18 against the tape so that the edge 18 transversely severs the tape. Tension in the tape during such orientation of the dispenser 10 will cause the cam surfaces 33 to guide the opposite edges of the tape between and around the locating tab portions 30 and will position the tape in the space between the retaining surfaces 32 and the cutting edge 16 before the cutting edge 16 can sever the tape. After the tape is severed, the newly formed end portion of the tape will contact and releasably adhere to the retaining surfaces 32, which is facilitated because of the convex curvature of the retaining surfaces 32 and complimentary concave curvature of the newly formed end portion of the tape that is caused by stresses formed in the backing of the tape when it was wound on the roll 11. The adhesion of the newly formed end portion of the tape to the retaining surfaces 32 will thus normally be retained until the end portion of the tape is pealed away by a user when another length of the tape is desired.

The combination according to the present invention has now been described with reference to one embodiment and a modification thereof. It will be apparent to those skilled in the art that many changes or modifications can be made in the embodiment described without departing from the scope of the present invention. Thus the scope of the present invention should not be limited to the structures described in this application, but only by structures described by the language of the claims and the equivalents of those structures.

I claim:

1. In combination:

a tape dispenser comprising a frame molded of polymeric material comprising a blade support portion, a cutting blade having a cutting edge adapted to transversely cut tape, and blade attachment means engaged between said cutting blade and said blade support portion of said frame for securing said cutting blade to said frame; and a hanger sheet having first and second opposite ends, a first end portion adjacent said first end and a second portion adjacent said second end having an opening adapted to receive a peg in a sales display area to hang the tape dispenser from the peg, said blade support portion comprising a dispenser wall having an inner surface, and a plurality of spaced projections from said inner surface having generally coplanar distal end surfaces, said first end portion of said hanger sheet having openings receiving said projections with said first end portion of said sheet around and extending between the openings that receive said projections, and said attachment means mounts said blade along said distal end surfaces with said first end portion of said hanger sheet between said cutting blade and said inner surface, said hanger sheet not being separable from said dispenser without separating parts of said hanger sheet.

2. A combination according to claim 1 wherein said frame has an end, said projections of said cutter support portion are spaced along said end, said cutting edge on said blade is parallel with and disposed at said end, and said second end portion of said hanger sheet projects past said cutting edge and said end of said flame.

3. A combination according to claim 2 wherein said projections are eIongate and are disposed with the length of the projections generally at a right angle to said end of the dispenser.

4. A combination according to claim 1 wherein said first end portion of said hanger sheet has at least one path of weakness defining parts of said hanger sheet that may be separated to facilitate removing said hanger sheet from said frame.

5. A combination according to claim 4 wherein said at least one path of weakness defining parts of said hanger sheet that may be separated to facilitate removing said hanger sheet from said frame extends transverse of said sheet through said openings in said first portion of said sheet.

6. A combination according to claim 4 wherein said first end portion of said hanger sheet has generally parallel paths of weakness from said openings to said first edge of said sheet defining parts of said hanger sheet may be separated to facilitate separation of said hanger sheet from said frame.

7. A combination according to claim 1 wherein said hanger sheet is of card stock and bears indicia providing trademark and use information.

8. A combination according to claim 1 wherein said first end portion of said hanger sheet has at least one path of weakness defining parts of said hanger sheet that may be separated.

* * * * *